US005597083A

United States Patent [19]

Childers et al.

[11] Patent Number: 5,597,083

[45] Date of Patent: Jan. 28, 1997

[54] CONTAINER WITH CHILD RESISTANT CAP

[75] Inventors: Terri C. Childers, Lawrenceville; Jack E. Haney, Norcross; Debra R. Joe, Alpharetta; William B. Mikolaitis, Lilburn; Randal D. Porter, Duluth; H. Neal Thomas, Norcross, all of Ga.

[73] Assignee: Silgan Plastics Corporation, Chesterfield, Mo.

[21] Appl. No.: 524,784

[22] Filed: Sep. 7, 1995

[51] Int. Cl.[6] ..... B65D 50/04

[52] U.S. Cl. ..... 215/220; 215/223; 215/330

[58] Field of Search ..... 215/209, 210, 215/215, 216, 217, 218, 219, 220, 221, 223, 330, 331, 235; 220/281

[56] References Cited

U.S. PATENT DOCUMENTS

| | | | |
|---|---|---|---|
| 3,329,293 | 7/1967 | Baumbach . | |
| 3,338,444 | 8/1967 | Velt | 215/220 |
| 3,612,323 | 10/1971 | Malick | 215/216 X |
| 3,733,001 | 5/1973 | Gach | 215/217 |
| 3,739,934 | 6/1973 | Bruno . | |
| 4,364,483 | 12/1982 | Golde | 215/218 |
| 4,413,742 | 11/1983 | Sandhaus | 215/216 |
| 4,535,905 | 8/1985 | Sandhaus | 215/218 |
| 5,115,928 | 5/1992 | Drummond, Jr. | 215/221 X |
| 5,205,424 | 4/1993 | Gaspar | 215/330 X |
| 5,234,118 | 8/1993 | Fillmore et al. | 215/220 |
| 5,236,107 | 8/1993 | Spahnstra, Sr. | 220/281 X |
| 5,509,550 | 4/1996 | DeJonge | 215/221 X |

*Primary Examiner*—Allan N. Shoap
*Assistant Examiner*—Nathan Newhouse
*Attorney, Agent, or Firm*—Pepe & Hazard

[57] ABSTRACT

A closure for a container with a threaded neck has a generally cylindrical body member and a disc pivotally mounted thereon. The body member has a peripheral wall with a lower, internally threaded skirt portion and a transversely extending wall intermediate the axial length of the body member above the skirt portion. The peripheral wall and transversely extending wall define a generally cylindrical cup portion above the transversely extending wall, and the transversely extending wall has a slot adjacent the inner periphery of the peripheral wall. The disc seats in the cup portion and is pivotally mounted on the peripheral wall of the body member about its periphery spaced above the transversely extending wall. The disc has a depending leg portion which extends through the slot in the transversely extending wall, and is pivotable about the points to move the leg portion downwardly and upwardly in the slot. As a result, the leg portion may be moved downwardly through the transverse wall to engage in a recess in the neck of the container and may be moved upwardly to disengage therefrom.

11 Claims, 2 Drawing Sheets

CONTAINER WITH CHILD RESISTANT CAP

BACKGROUND OF THE INVENTION

The invention relates to containers and, more particularly, to containers including a child-resistant closure.

As is well known, child-resistant closures are now widely employed to close containers and render it difficult for a child to remove the closure to obtain access to the contents of the container. These closures are produced in a variety of sizes and configurations.

Generally, the design of child-resistant closures represents a tradeoff between preventing children from obtaining access to the contents of the container and facilitating easy removal of the closure by elderly or debilitated adults. Moreover, some existing child-resistant closures may be inadvertently opened, some have unsightly protuberances, and some are generally relatively complicated in construction and expensive to manufacture.

Accordingly, it is an object of the present invention to provide a novel, child-resistant closure which can be readily opened by an elderly or debilitated adults while limiting access to the container contents by infants or young children.

It is also an object of the present invention is to provide such a child-resistant closure which reduces the likelihood of being inadvertently opened and which is relatively simple in construction and may be economically fabricated.

Another object of the present invention is to provide such a child-resistant closure assembly which is attractive in appearance.

SUMMARY OF THE INVENTION

It has now been found that the foregoing and related objects may be readily attained in a closure for a container with a threaded neck having a generally cylindrical body member and a disc member mounted thereon. The body member has a peripheral wall with a lower, internally threaded skirt portion and a transversely extending wall intermediate the axial length of the body member above the skirt portion. The peripheral wall and transversely extending wall define a generally cylindrical cup portion above the transversely extending wall, and the transversely extending wall has a slot therein adjacent the inner periphery of the peripheral wall. The disc member seats in the cup portion and is pivotally mounted on the peripheral wall of the body member at two points about its periphery spaced above the transversely extending wall. The disc member has a depending leg portion adjacent its periphery which extends through the slot in the transversely extending wall. The disc is pivotable about the points to move the leg portion downwardly and upwardly in the slot. As a result the leg portion may be moved downwardly through the transverse wall to engage in a recess in the neck of the container and may be moved upwardly to disengage therefrom.

Preferably, the peripheral wall of the cup portion of the body member has an axially extending notch in its upper end diametrically spaced from the slot. Desirably, the two pivot points of the disc member are diametrically spaced.

The leg portion of the disc member has an arcuate cross section and an outer surface which is tapered inwardly at its lower end.

Preferably, the disc member is pivotable into a horizontal plane adjacent the upper end of the cup portion when the disc member is in the first position, and the portion of the disc member adjacent the leg portion extends above the plane when the disc member is in the second position.

In assembly, the closure is threadably engaged with the neck of a container having a body and a threaded neck with an axially extending recess at the upper end thereof extending over a limited portion of the circumference thereof. The disc is pivotable to move the leg portion downwardly in the slot into a first position in which it seats in the recess of the container neck to prevent rotation of the closure, and the disc is pivotable upwardly in the slot to move the leg portion into a second position in which it is removed from the recess to allow rotation of the closure about the neck.

DETAILED DESCRIPTION OF THE PREFERRED EMBODIMENT

Figure 1:
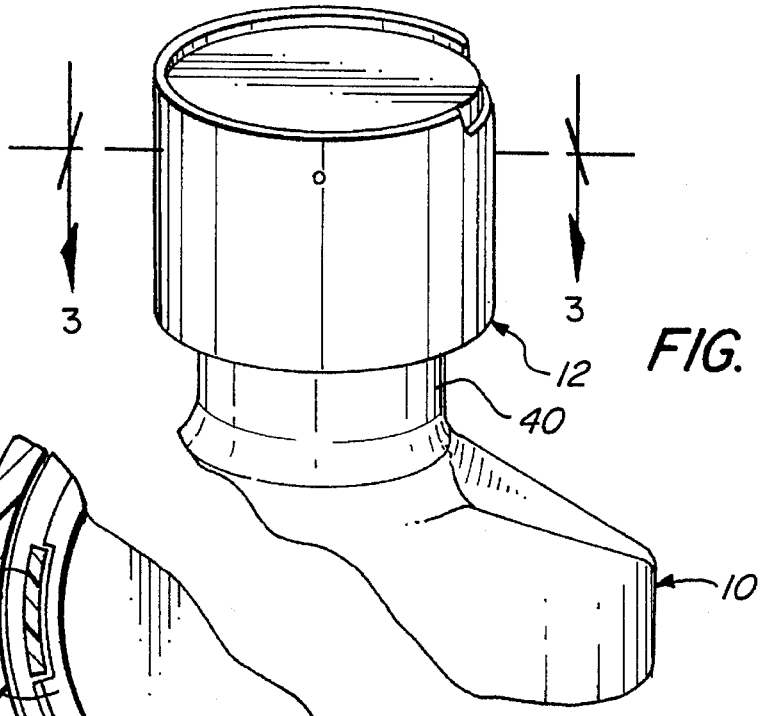
FIG. 1 is a fragmentary perspective view of a container assembly embodying the present invention.

Turning first to FIG. 1, therein illustrated fragmentarily is a container assembly embodying the present invention which includes a container generally designated by the numeral 10 with a neck designated by the numeral 40 upon which is seated a closure generally designated by the numeral 12.

Figure 2:
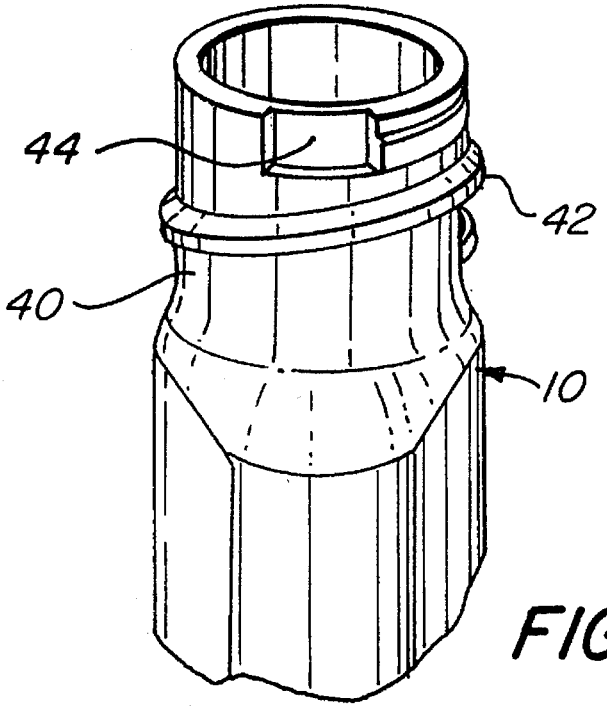
FIG. 2 is a fragmentary perspective view of the neck of the container of FIG. 1.

As best illustrated in FIG. 2, the neck 40 includes spiral threads 42 adjacent its upper end. The threads 42 are generally continuous except for a break caused by a recess 44 at the upper end of the neck 40 which extends axially along the side of the neck. The recess 44 may be formed easily when the container 10 is molded and has its inner surface concentric with the generally circular outer periphery of the neck 40 and threads 42. The recess 44 is of arcuate cross-section and of limited radial depth so that it the structural integrity of the neck 40 is maintained and the contents may be dispensed about the entire periphery of the neck.

Figure 3:
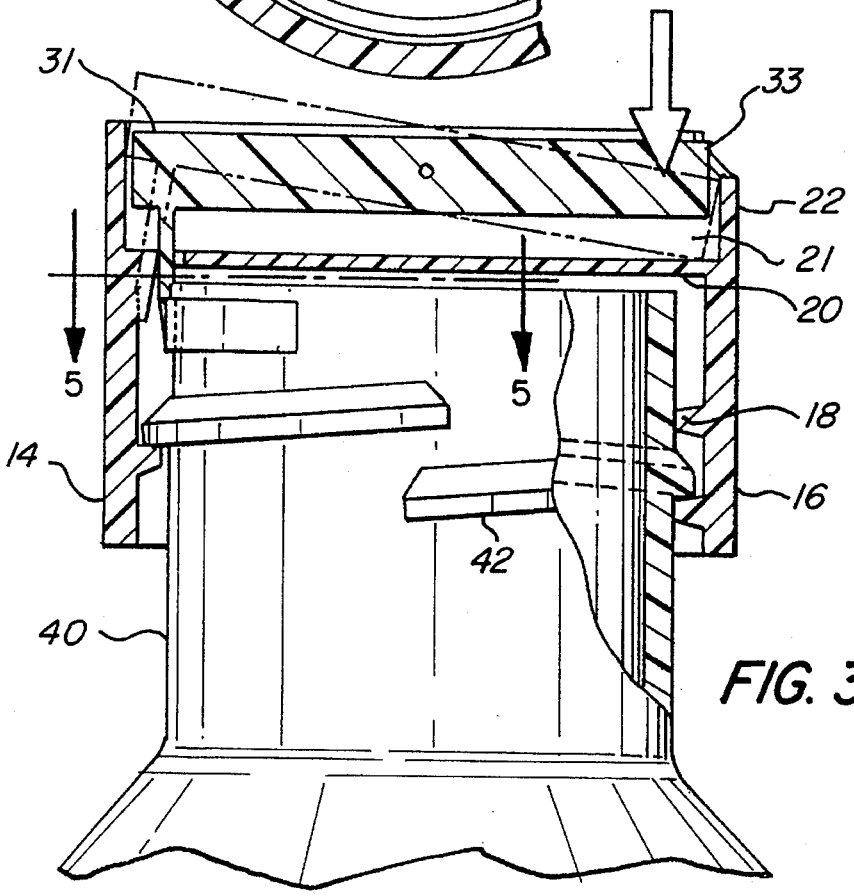
FIG. 3 is a sectional view of the container assembly along the line 3—3 of FIG. 1 drawn to an enlarged scale.
Figure 4:
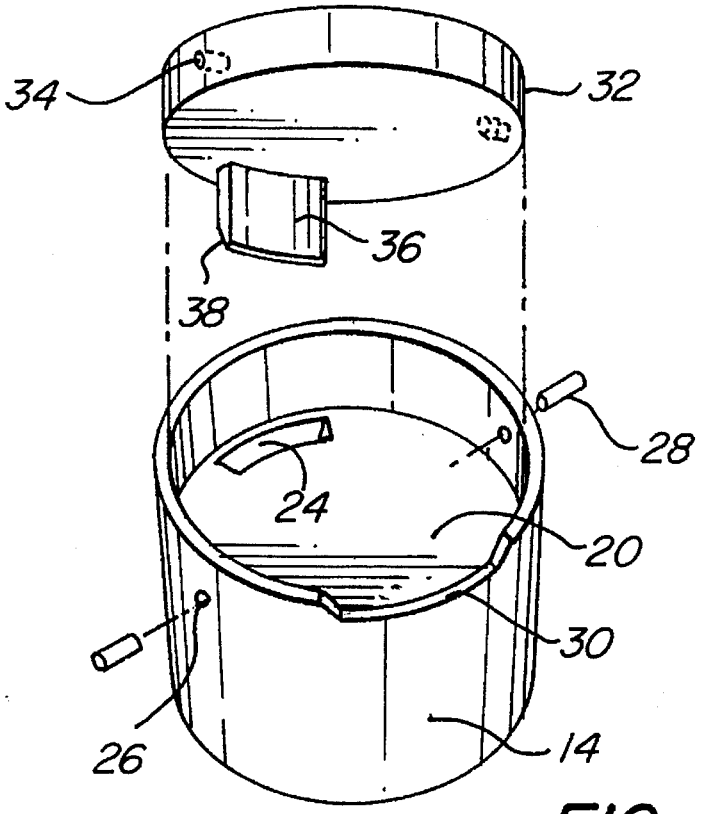
FIG. 4 is an exploded view of the closure.

As seen in FIG. 4, the closure 12 has a generally cylindrical body member 14 with a transverse wall 20 intermediate its axial length which may abut the upper end of the neck 40 and thereby seal the container 10. The transverse wall 20 has an arcuate slot 24 adjacent the inner periphery of the peripheral wall of the body member 14 and axially aligned with the recess 44 on the neck 40 of the container 10 as illustrated in FIG. 3.

Extending below the transverse wall 20 is a skirt portion 16 which is internally threaded to mesh with the threads 42 on the neck 40 of the container 10 to secure the closure 12 on the container 10.

Above the transverse wall 20 is a cylindrical cup portion defined by the transverse wall 20 and the peripheral wall of the closure body 14. The upper end of the peripheral wall of the cup portion 22 has an axially extending notch 30 diametrically spaced from the slot 24.

A disc 32 is pivotally mounted on the body member 14 within the cup portion 22 by a pair of cylindrical pins 28 which seat in apertures 26 in the peripheral wall of the closure member 14 and in diametrically opposed recesses 34 in the periphery of the disc 32, as illustrated in FIGS. 1, 3 and 4. The operations 26 are spaced above the traverse wall 20 adjacent the upper end of the peripheral wall of the body member 14 so that the ends of the disc 32 may freely pivot within the cavity 21 provided by the cup portion 22.

Figure 5:
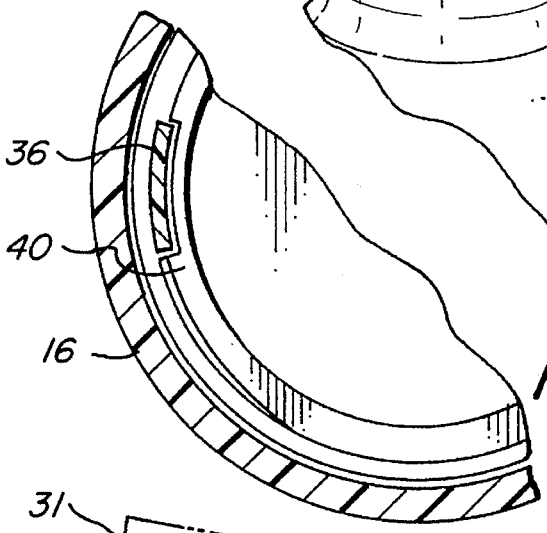
FIG. 5 is a fragmentary sectional view of the container assembly along line 5—5 of FIG. 3.

As illustrated in FIGS. 3, 4 and 5, the disc 32 has a depending arcuate tab or leg portion 36 adjacent its periphery which extends through the slot 24 in the transverse wall 20 and seats in the recess 44 on the neck 40 to lock the closure 12 in a stationary position and prevent its rotation about the neck 44.

In order to release the closure 12 and allow it to rotate about the neck 44, one merely depresses the end 33 of the disc 32 diametrically spaced from the tab 36 and adjacent the notch 30 in the direction shown by the arrow in FIG. 3 until the upper surface of the end 33 of the disc 32 is flush with the base of the notch 30. This pivotal movement causes the end 31 of the disc 32 adjacent the tab 36 to move upwardly and moves the tab 36 outwardly of the recess 44. The outer surface 38 of the tab 36 is tapered inwardly at its lower end to thereby extend the range of travel of the disc 32 when the tab 36 is pivoted upwardly. The tab 36 is removed from the recess 44 when its outer surface 38 abuts the inner periphery of the skirt 16, and the lower surface of the end 33 of the disc 32 abuts the upper surface of the transverse wall 20.

The notch 30 allows the user's finger to pivot the end 33 of the disc 32 downwardly more easily to release the locking action. Pressing downwardly on the end 31 easily pivots the disc into the locking position.

It is visually apparent when the closure assembly 12 is in the locked position because the upper surface of the disc 32 lies in a horizontal plane closely adjacent the upper end of the cup portion 22, as illustrated in FIGS. 1 and 3. In the unlocked position shown in phantom line on FIG. 3, the end 31 of the disc 32 adjacent the tab 36 extends above the plane of the upper end of the cup portion 32. The recessed mounting of the disc 32 within the cup portion 22 provides the closure with a smooth, attractive appearance with no unsightly protuberances and reduces the likelihood of the closure being inadvertently opened if the container is dropped.

As will be appreciated, the configuration of the interfitting portions may vary from that which is illustrated in the accompanying drawings. For example, the disc may have either bosses or recesses which cooperate with bosses or recesses in the cup portion to pivotally mount the disc within the cup portion.

As will further be appreciated, various materials may be employed for the construction of the container assembly. Most conveniently, the closure elements are molded from synthetic resin which has acceptable resiliency, is relatively inexpensive to mold, and durable.

Thus, it can be seen from the foregoing detailed description and attached drawings that the child-resistant closure assembly of the present invention can be readily opened by an elderly or debilitated adults. However, it will also reduce the likelihood of access to the container contents by infants or young children.

Having thus described the invention, what is claimed is:

1. A closure for a container with a threaded neck comprising:

(a) a generally cylindrical body member having a peripheral wall with a lower, internally threaded skirt portion and a transversely extending wall intermediate the axial length of said body member above said skirt portion, said peripheral wall and transversely extending wall defining a generally cylindrical cup portion above said transversely extending wall, said transversely extending wall having a slot therein adjacent the inner periphery of said peripheral wall; and (b) a disc member seated in said cup portion and pivotally mounted on said peripheral wall of said body member at two points about its periphery spaced above said transversely extending wall, said disc member having a depending leg portion adjacent its periphery and extending through said slot in said transversely extending wall, said disc being pivotable about said points to move said leg portion downwardly and upwardly in said slot, whereby said leg portion may be moved downwardly through said transverse wall to engage in a recess in the neck of an associated container and movable upwardly to disengage therefrom.

2. The closure in accordance with claim 1 wherein said peripheral wall in said cup portion of said body member has an axially extending notch at in upper end thereof diametrically spaced from said slot.

3. The closure in accordance with claim 1 wherein said two pivot points of said disc member are diametrically spaced.

4. The closure in accordance with claim 1 wherein said leg portion of said disc member has an arcuate cross section.

5. The closure in accordance with claim 1 wherein the outer surface of said leg portion is tapered inwardly at its lower end.

6. A container assembly comprising:

(a) a container having a body and a threaded neck with an axially extending recess at the upper end thereof extending over a limited portion of the circumference thereof; and, (b) a closure threadably engaged with said neck of said container and including (i) a generally cylindrical body member having a peripheral wall with a lower, internally threaded skirt portion threadably engaged with said neck of said container, a transversely extending wall intermediate the axial length of said body member above said skirt portion, said peripheral wall and transversely extending wall defining a generally cylindrical cup portion above said transversely extending wall, said transversely extending wall having a slot therein adjacent the inner periphery of said peripheral wall and aligned with said recess in said neck; and, (ii) a disc member seated in said cup portion and pivotally mounted on said peripheral wall of said body member at two points about its periphery and spaced above said transversely extending wall, said disc member having a depending leg portion adjacent its periphery and extending through said slot in said transversely extending wall, said disc being pivotable to move said leg portion downwardly in said slot into a first position in which it is seated in said recess of said container neck to prevent rotation of said closure, said disc being pivotable upwardly in said slot to move said leg portion into a second position in which it is removed from said recess to allow rotation of said closure about said neck.

7. The closure assembly in accordance with claim 6 wherein said disc member is pivotable into a horizontal plane adjacent the upper end of said cup portion when said disc member is in said first position, and the portion of said disc member adjacent said leg portion extends above said plane when said disc member is in said second position.

8. The closure assembly in accordance with claim 6 wherein said peripheral wall in said cup portion of said body member has an axially extending notch at in upper end thereof diametrically spaced from said slot.

9. The closure assembly in accordance with claim 6 wherein said two pivot points of said disc member are diametrically spaced.

10. The closure assembly in accordance with claim 6 wherein said leg portion of said disc member has an arcuate cross section.

11. The closure assembly in accordance with claim 6 wherein said the outer surface of said leg portion is tapered inwardly at its lower end.

* * * * *